US005481242A

United States Patent [19]

Caddock, Jr.

[11] Patent Number: 5,481,242

[45] Date of Patent: Jan. 2, 1996

[54] DEBRIS-REDUCING TELEPHONE RESISTOR COMBINATION AND METHOD

[75] Inventor: Richard E. Caddock, Jr., Winchester, Oreg.

[73] Assignee: Caddock Electronics, Inc., Riverside, Calif.

[21] Appl. No.: 240,322

[22] Filed: May 10, 1994

[51] Int. Cl.[6] ..... H01C 1/012

[52] U.S. Cl. ..... 338/306; 338/308; 338/309; 338/314; 338/21; 361/104; 361/119

[58] Field of Search ..... 338/306, 21, 308, 338/309, 314; 361/104, 119

[56] References Cited

U.S. PATENT DOCUMENTS

| | | | |
|---|---|---|---|
| 3,778,644 | 12/1973 | Brandi | 338/260 |
| 3,978,443 | 8/1976 | Dennis | 338/309 |
| 4,297,670 | 10/1981 | Solow | 338/195 |
| 4,467,310 | 8/1984 | Jakab | 338/22 R |
| 4,528,546 | 7/1985 | Paoli | 338/195 |
| 4,630,025 | 12/1986 | Bourolleau | 338/309 |
| 4,809,324 | 12/1989 | Bender | 379/412 |
| 4,939,498 | 7/1990 | Yamada et al. | 338/22 R |
| 4,959,751 | 9/1990 | Hearn et al. | 361/406 |
| 4,961,065 | 10/1990 | Taylor | 338/308 |
| 5,204,799 | 4/1993 | Stibila | 361/104 |
| 5,252,944 | 10/1993 | Caddock, Jr. | 338/275 |
| 5,254,969 | 10/1993 | Caddock, Jr. | 338/308 |
| 5,291,178 | 3/1994 | Strief et al. | 338/226 |
| 5,404,126 | 4/1995 | Kasai et al. | 338/21 |

FOREIGN PATENT DOCUMENTS

| | | | |
|---|---|---|---|
| 0395231 | 10/1990 | European Pat. Off. | H01H 85/046 |
| 2109760 | 2/1971 | Germany . | |
| 3245629 | 12/1982 | Germany | H01H 85/14 |
| 2163307 | 2/1986 | United Kingdom | H01H 85/14 |

*Primary Examiner*—Marvin M. Lateef
*Attorney, Agent, or Firm*—Richard L. Gausewitz

[57] ABSTRACT

A telephone resistor combination and method, that is formed by a ceramic substrate having a resistive film on it, and pins on one edge of the substrate and connected to the film. A U-shaped cold region is provided on the substrate around at least much of the film, and is so constructed that application of common high overload voltages to the pins causes vertical fracture of the substrate. The resulting substrate pieces are held by the pins to the circuit board.

43 Claims, 5 Drawing Sheets

DEBRIS-REDUCING TELEPHONE RESISTOR COMBINATION AND METHOD

FIELD OF THE INVENTION

This invention relates generally to resistors of the type that fracture in response to high electrical overloads in order to interrupt the current flow through the resistor. There are shown and described telephone line balancing (telephone line interface) resistors that are fracturing resistors.

BACKGROUND OF THE INVENTION

It has long been known that it would be extremely desirable to achieve fracturing resistors that are reliable, fast-acting, practical, commercial, compact and strong, yet such that, in at least the vast majority of cases when fracturing occurs, the resulting debris does not drop onto or away from the circuit boards on which the resistors are mounted. Otherwise, the debris may fall randomly, for example, into the electronic systems (electronics) of which the resistors are part.

Any prior-art fracturing resistors that attempted to achieve debris reduction were unreliable, slow, or otherwise unsatisfactory in operation, or were impractical, excessively large, inefficient, or deficient in other ways.

SUMMARY OF THE INVENTION

It has now been discovered that by certain applications of what the applicant terms the principle of U-shaped containment, fracturing resistors (and associated methods) are achieved and are such that the resulting debris remains reliably in place instead of tending to drop onto the circuit board or elsewhere.

In accordance with one aspect of the present invention, U-shaped cold (relatively cold during electrical overload) regions are provided on the resistors, and terminals are provided along one edge of the resistors, in such relationship that when a high overload occurs, a thermal stress-caused fracture line (crack) extends generally away from and/or toward that edge having the terminals, so that the terminals remain effective to hold the ceramic substrate in position on the circuit board and no debris can drop onto the board or elsewhere.

In accordance with another aspect of the invention, that edge of the resistor having the terminals is provided with extra solder that operates as an anchor to reduce further the chances that debris will drop onto the circuit board or elsewhere.

In accordance with another aspect of the invention, the fracturing resistors are provided in combination with fusible elements that operate to break the circuit or circuits in situations when the overload is not sufficiently high to cause fracturing.

In accordance with another aspect of the invention, fracturing resistors are provided in which the current-conducting resistive film has serpentine patterns.

BRIEF DESCRIPTION OF THE DRAWINGS

All of the below-described views are elevational views, showing the parts in the orientations that would be assumed when mounted on horizontal circuit boards.

DETAILED DESCRIPTION

U.S. Pat. No. 5,254,969 for a Resistor Combination and Method is hereby incorporated by reference herein.

Throughout this Specification and Claims, the words "frontside heating" denote heating of a substrate caused by resistive film actually present on the frontside of the substrate. The words "backside heating" denote heating of the substrate caused by resistive film actually present on the backside of the substrate.

Proceeding first to a description of the embodiment of FIGS. 1–6, there is shown a telephone line balancing resistor pair embodying the invention and the method of the invention. The most common high electrical overload abuse to which such resistors (in that industry) are subjected results when the most common electrical power distribution voltages accidentally contact the telephone line. (In the United States the most common electrical distribution voltages are 120 volts rmsAC [root mean square alternating current], 208 volts rmsAC, or 230 volts rmsAC.) The resulting voltage delivered through the telephone line to the balancing resistors causes a substantial overload and consequent fracturing. The rmsAC overload voltages present at the resistor, and which cause fracture, are most commonly and typically in the range of about 60 volts rmsAC to about 230 volts rmsAC.

The balancing resistor pair of FIGS. 1–6 has a thin, flat, elongate rectangular substrate 10. The thermal coefficient of expansion of substrate 10 is sufficiently high to effect the desired fracturing but not so high that fracturing occurs at excessively low overloads.

Figure 1:
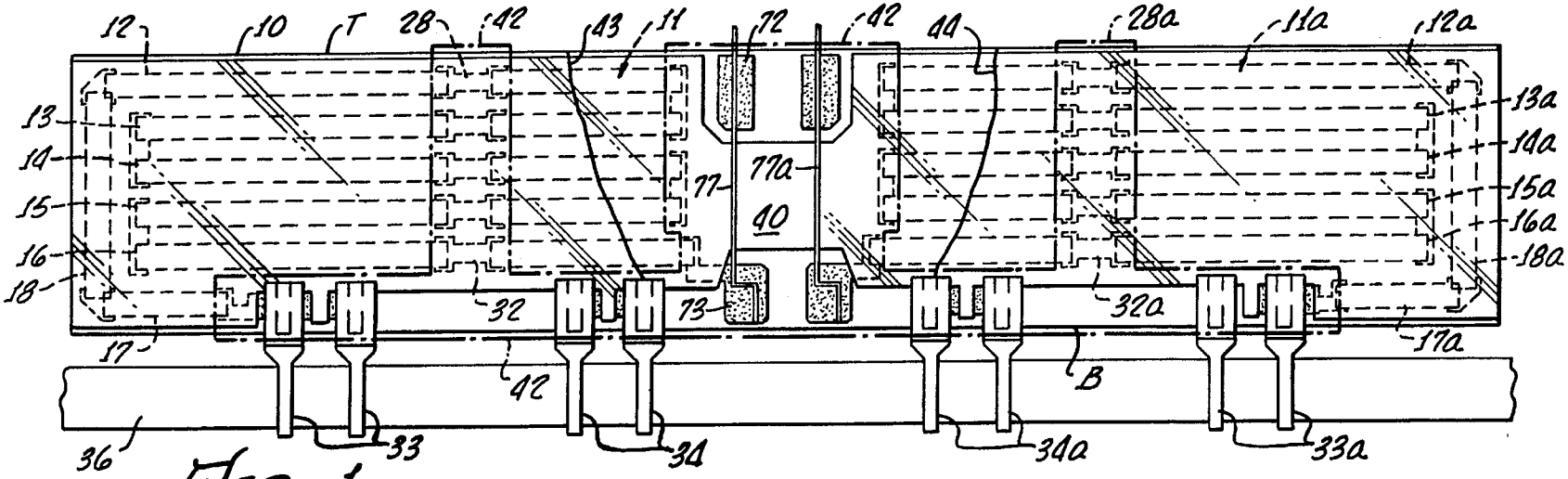
FIG. 1 is a frontside view of a first embodiment of the fracturing resistors, as mounted on a circuit board, the board being shown unhatched.
Figure 3:
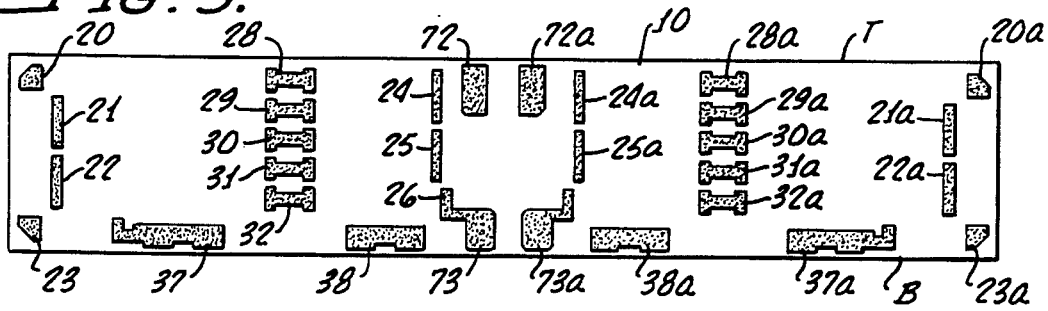
FIG. 3 is a frontside view thereof, showing only the substrate and metalizations.
Figure 5:
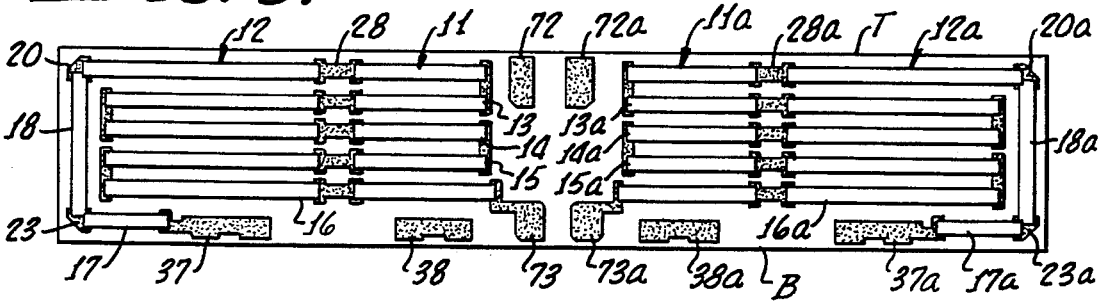
FIG. 5 is a frontside view thereof corresponding to FIG. 3 but showing also the resistive films.

Proceeding to a description of the frontside of substrate 10, there are two screen-printed films ("thick films") that are serpentine in shape, each film being the mirror image of the other about the CL (vertical center line of the substrate). Correspondingly, the terminals associated with the films are mirror images about the CL. The films and terminals being mirror images, only those at the left side of the CL in FIGS. 1, 3 and 5 are described. Corresponding elements on the right side of the CL in such figures are given the same reference numerals but followed by the letter "a".

The serpentine film is numbered 11 and has its runs extending horizontally, these being numbered 12–17 from top to bottom. Top and bottom runs 12 and 17 extend farther to the left than do those between them and are connected by a vertical run 18 that is close to the left end of the substrate. The various runs 12–18 are close to each other, and 12–17 are parallel to each other. Top run 12 is close to the top edge T of the substrate, but run 16 is spaced from the bottom edge B thereof.

To the extent that the serpentine film 11 is formed of resistive material, a large amount of frontside heating of substrate 10 is caused by such serpentine film. The entire serpentine film 11 is formed of resistive material—with the major exceptions stated below.

Referring next to FIG. 3, there are shown highly-conductive metalizations that are screen-printed onto the frontside of substrate 10. Metalizations 20–26 (inclusive) are corner conductors for serpentine film 11; these greatly increase conductivity at the corners and thereby augment the uniformity of current distribution in the resistive film. Corner conductors 20, 23, and 26 are for right-angle corners, while corner conductors 21, 22, 24, and 25 are for reverse-bent corners.

Five of the metalizations, which may be called cold bars, are provided in horizontally-elongate shape and orientation and are in vertical alignment with each other. These are numbered 28–32.

The corner conductors and cold bars are all so located on substrate 10 as to fit into the serpentine pattern of film 11, as shown in FIGS. 1 and 5.

Referring to FIG. 5, there is overprinted onto substrate 10 a resistive film (meaning resistance film having a relatively high resistivity—namely a resistivity which is high relative to the resistivity of the connecting metalization—and that accordingly results in generation of substantial heat in the resistance film when overload current flows through it). The resistive film, in most instances, extends between the various corner conductors and the cold bars.

Terminals (terminal pins) 33, 34 (FIG. 1) are connected by soldering to the metalization pads at the bottom edge B of substrate 10 and are subsequently soldered into holes in line card or circuit board 36 shown in FIG. 1. In the illustrated form, there are two terminals 33 that connect to the same metalization pad 37 on the frontside of the substrate (FIG. 3).

The terminals 33 and their pad 37 are (in the present example) spaced a substantial distance to the right from the left edge of substrate 10. Terminals 34 connect to a blind pad 38 that is spaced to the right from pad 37, these also being soldered into the line card.

The terminal pins and their mechanical connections to the substrates are preferably stiff, so as to keep the substrate sections vertical before and after fracture occurs. The sectional view of FIG. 9*a* (drawing sheet 3) applies to all of the embodiments set forth in this application—being of the conventional "jaw" type.

The bottom run 17 of serpentine film 11 is short and at the left end of the substrate, extending along the bottom substrate edge from corner conductor 23 to pad 37.

An overglaze 40 is provided on the frontside, as indicated in FIG. 1. The overglaze is not (except as stated below) present at pads 37, 38, or at the lower edge regions of the substrate inboard of outer terminals 33, nor is it present at other pads described subsequently relative to the central region of the substrate. Despite what is stated in the preceding sentence, there are narrow fingers of overglaze separating the terminal attachments on the pads, as shown.

DESCRIPTION OF THE METHOD AND OF THE OPERATION OF THE ARTICLE AS THUS FAR DESCRIBED

As the result of the present method and in accordance with the invention, fracture (cracking) of substrate 10 is achieved which is reliably and repeatably in generally a particular direction and a particular area. The direction is generally or substantially vertical or transverse relative to the bottom edge B of substrate 10, and generally vertical or transverse relative to the top edge T. Also in accordance with the method, such bottom edge is connected to and supported by the terminals 33, 34 to circuit board or telephone line card 36, so that because the fracture is generally vertical, the pieces of the substrate may therefore not fall onto the circuit board or elsewhere, but instead remain in place. However, and particularly because of the direction of the long runs of the serpentine film, the fracture is substantially certain to break the circuit through the film 11 so that the desired "fuse" action is reliably achieved.

The method is such that the location of the fracture is generally between the cold bars 28–32 and the corner conductors 24, 25 (FIG. 3). Accordingly, the fracture does not normally occur, under the most common high electrical overload abuse conditions, at the left end of the substrate (this being the end outboard of terminals 33). Because of this, and because of additional safety factors relative to certain forms of the method and article, the chances of resistor debris dropping onto the line card or elsewhere are further reduced to a very low percentage.

To state the above in another manner, the repeatable, substantially vertical fracture is, in accordance with the present method, in the great majority of instances directed toward or away from the terminals (pins) that are electrically and mechanically bonded to the bottom edge of the ceramic and to the line card or circuit board. The pieces created by the substantially vertical fracture are then held and may not fall away. (It is pointed out that the direction of propagation of the fracture—whether it starts at the top or bottom or is simultaneous throughout—is irrelevant.)

In many cases, the fracture is barely noticeable—being a crack in the ceramic substrate without substantial dimensional separation. This crack in the ceramic destroys or greatly damages the support of the resistive film (resistor deposit) which is directly over the crack, thereby causing quick opening (burnout) of the resistor at that location. The circuit is thus opened quickly, quick enough not to melt or damage the fine wires which are connected to the telephone system, or cause heat damage to the circuit board due to the heating of the resistors.

It was originally thought by the applicant that the vertical fracture method required, for most effectiveness, a serpentine or meandering resistive film (resistor) pattern. It has, however, since been learned that the method is also very effective relative to solid (continuous over a substantial area) deposits of resistive material, as subsequently described relative to FIGS. 7–15.

Further in accordance with the method, a particular pattern of what is for convenience called "cold regions," or "cold areas," or "cold arms," is deliberately and intentionally created (provided) for the purpose of causing the stated generally vertical stress fracture of the substrate 10, to thus achieve the fuse action described above and below. It is to be understood that there is no generation of "cold" in the refrigeration sense, but instead the absence of generation of heat (frontside heating) during high electrical overloads in certain parts of the frontside of the substrate.

The pattern of frontside cold—meaning relative cold in relation to frontside-heated areas—is generally U-shaped, with the U opening upwardly and having its base at the bottom edge region of the substrate.

Referring to FIG. 1, the phantom line 42 shows the U-shaped cold area (on each side of the CL). Thus, there is one vertical cold arm through the cold bars 28–32 (FIG. 3); there is a second vertical cold arm at and to the right of corner conductors 24, 25; and there is a horizontal U-base extending between the lower regions of such vertical arms along the lower edge portion of the substrate.

To state the method in another way, there is intentionally created what may be termed "U-shaped containment" of a heat-generating area. When a sufficiently high electrical overload occurs, the heat-generating area defined within the stated U-shaped region—namely, the area between the vertical cold arms of the U—rapidly expands due to the resistor heating and the thermal coefficient of expansion of the ceramic substrate material. This causes increasing strain in the ceramic between the arms of the U due to the thermal contrast in the cold area and the contained, expanding heat-generating area. The increasing strain results in the essentially vertical fracture, an example of which is shown at 43 on the left half of the resistor (FIG. 1), and another example is shown at 44 on the right half of such resistor.

Further in accordance with the method, any cold region at the top of the substrate is intentionally made as thin as practical relative to the three sides of the U to thereby reduce greatly the possibility of random breakage as distinguished from generally vertical breakage.

Also, in accordance with the method, the size of the heat-generating area (frontside heating) is intentionally made sufficiently large to achieve the stated expansion of a relatively large area (proportion) of the substrate. Furthermore, and very importantly, each arm of the U is intentionally made sufficiently wide that the cold there maintains sufficient thermal contrast relative to the thermal conductivity of the substrate and will contain the heated expanding ceramic so as to result in sufficient thermal stress to cause the fracture described.

The region of the substrate to the right of corner bars 24, 25 (FIG. 3), being the right vertical arm of the U, is cold because there is no resistive film over a relatively large area that extends to the CL. (It is to be understood that there is a corresponding cold area to the right of the CL and which relates to the resistive film to the right thereof.) The left vertical arm of the U is caused by the high-conductivity cold bars 28–32 through which the current flows without generating substantial heat.

The preceding paragraph is not meant to imply that the unheated center of the resistive device (FIG. 1) is wide for reasons of thermal shock fracture. Instead, it is wide because of the below-described fuse elements 77. Were it not for the present of fuse elements 77, the entire unheated center of the U could be as wide as the above-indicated left vertical arm of the U (such is the case in the embodiment of FIGS. 7–9 hereof).

In the illustrated embodiment, there is—as shown in FIG. 5—no resistive film printed over the central regions of the cold bars. It is to be understood, however, that there could be resistive film either below or above such high-conductivity cold bars because the current would then flow through the cold bars and would not flow in substantial amount through the underlying or overlying resistive film.

The width (horizontal dimension) of each vertical arm of the U is greater than 0.050 inch, preferably greater than 0.060 inch, and in the best embodiment of the method (and article) is about 0.1 inch. In at least the latter instance, the substrate breaks generally vertically at all overload voltages most frequently applied to telephone circuit balancing resistor pairs in telephone system operation.

The vertical dimension of the base of each cold U is caused to be substantially equal to—or somewhat less than—the horizontal dimension of each arm of the U.

Preferably, the heated area continued within the U is generally square; this permits reduction in the widths of the arms (and base) of the U necessary to reliably achieve vertical fracture.

It is a feature of the invention that use is made of cold (unheated) space which is often present along the bottom edges of many resistors, to form the base of each U. This increases the efficiency of utilization of substrate area.

Further in accordance with the method, any backside heating (resistive heating of the back of the substrate) is, at least in the region registered with the U, such as not to interfere with the stated U-shaped containment and consequent desired vertical fracture. Stated otherwise, it does not impact the thermal contrast of the cold frontside U versus the contained heat-generating frontside area.

The thinner the ceramic, the more the backside pattern will impact the frontside pattern.

Three instances (not all-inclusive) where there is no such interference with the described U-shaped containment are: (1) where there is no resistive film on the back of the substrate; (2) where the resistive film on the back of the substrate is such that the backside heating is fairly uniform, at least in the region registered with the U and the area surrounded by the U; and (3) where the pattern of film on the backside is such that there is a backside cold U generally registered with the frontside cold U and a backside contained heat-generating area generally registered with the frontside contained heat-generating area. One desirable pattern of backside film, and which does not interfere with the U-shaped containment, is described under the next subheading.

One instance (not all-inclusive) where there is (or may be) such interference is where the power density on the backside is so high—at least in the vicinity of the frontside U—as to dominate the thermal effects occurring on the frontside.

In a form of the invention that is not presently preferred—one reason being that it does not permit many film patterns or efficient use of substrate area, the cold area is V-shaped instead of U-shaped or substantially U-shaped. With a V-shaped cold region, the resistive film within the V is normally serpentine, the runs of which progressively change in length.

One of the advantages of the present invention is that no horizontal metalization trace is required in spaced relationship above the resistive films, nor are vertical metalization traces required at the substrate ends in spaced relationship from the resistive film. Space is thus saved, and the crack or fracture need not intersect a metalization trace.

DESCRIPTION OF THE BACKSIDE, EMBODIMENT OF FIGS. 1–6

Figure 2:
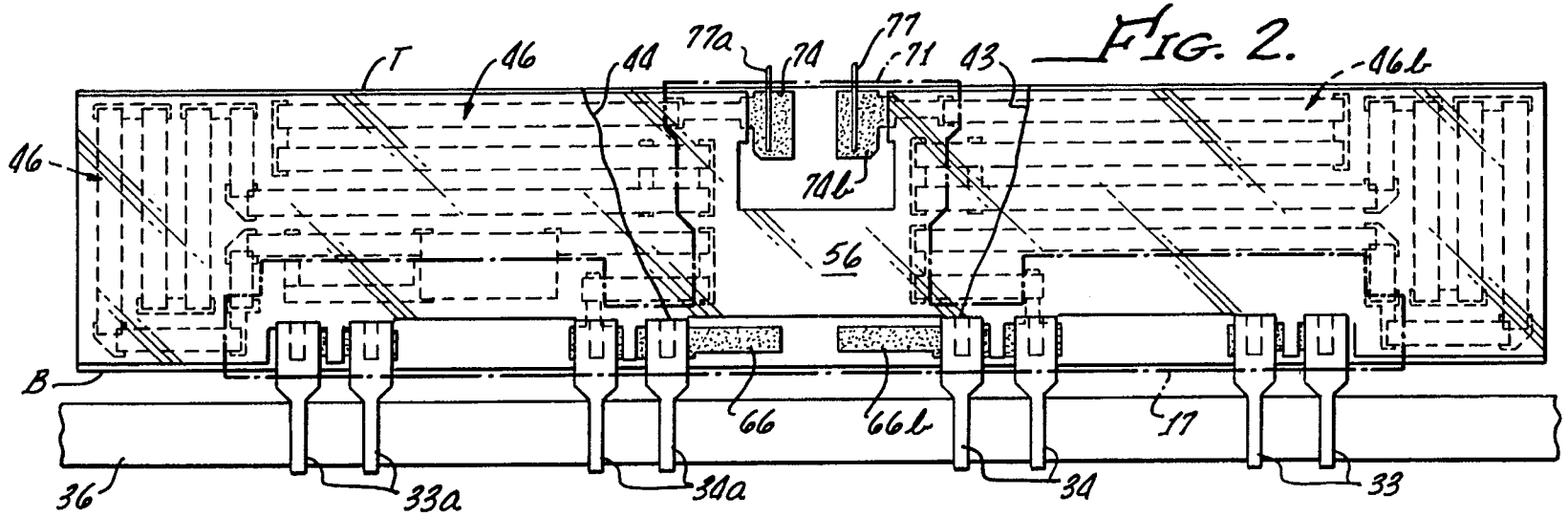
FIG. 2 is a backside view thereof.
Figure 4:
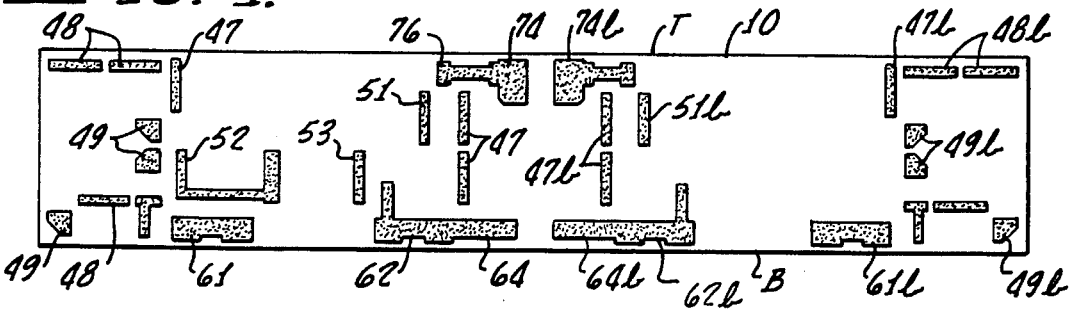
FIG. 4 is a backside view thereof showing only the substrate and metalizations.
Figure 6:
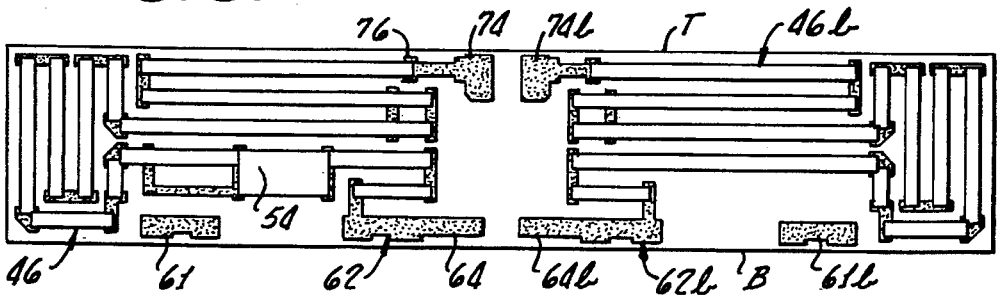
FIG. 6 is a backside view thereof corresponding to FIG. 4 but showing also the resistive films.

Referring next to FIGS. 2, 4, and 6, there is shown the backside of the resistor described in detail above. Except as specifically stated below, the elements of the right side of the CL in FIGS. 2, 4, and 6 are the mirror images of those on the left side thereof, and are accordingly given the same reference numerals except followed in each instance by the letter "b".

As shown in FIGS. 2 and 6, a meandering, serpentine film 46 is illustrated. Such film has a vertical pattern at the left end thereof and a horizontal pattern disposed between such vertical pattern and the CL. Because film 46 is formed primarily of resistive material, there is backside heating of the substrate 10 except at the central region of the substrate, and except at the lower portion of the substrate that is below the horizontal film.

The inboard half of the horizontal film pattern on the backside is substantially registered with that portion of the frontside serpentine pattern that is inboard of cold bars 28–32.

Referring to FIG. 4, showing metalizations, there are vertically-oriented corner conductors 47 for the return-bent corners of the horizontal portion of film 46. There are also horizontally-oriented corner conductors 48 for the return-bent corners of the vertical portion of film 46. There are also corner conductors 49 for the right angle portions of film 46.

For trimming and balancing resistance values on the backside, there is a shunting conductor 51 parallel to and outwardly adjacent the uppermost vertical corner conductor 47. For more extensive trimming, there is a U-shaped conductor 52, and inboard of which is a vertical conductor 53. These elements 52, 53 are only—in the illustrated embodiment—provided on the left side of the CL as viewed in FIG. 4 but could be on both sides. The resistive film is overprinted in the illustrated meandering, serpentine pattern, extending between the various corner conductors 47, 48 and 49. The shunting conductor 51 is adapted to be laser cut in order to extend the length, somewhat, of the loop between the second and third (from the top) runs of the horizontal film pattern.

A trim film 54 is provided between vertical conductor 53 and the right arm of U-shaped conductor 52. This film 54 is adapted to be laser-trimmed in a horizontal direction with one or more laser-cut lines in order to effect fine trimming. Prior thereto, the U-shaped conductor 52 is adapted to be laser-cut in order to introduce into the film pattern that film region lying between the arms of the metalization U.

The most trimming is effected near the bottom portion of the substrate in order that the heating of the upper portion of the substrate will not be much affected. This is especially true in those instances (not shown here) when laser trimming is provided on the frontside of the substrate instead of the backside thereof.

Referring next to FIG. 2, the backside films are overprinted with glass 56, except at the lower edge regions (inboard of the outer terminals) and at portions of the middle.

DESCRIPTION OF ADDITIONAL MEANS FOR PREVENTING DEBRIS FROM DROPPING ONTO THE CIRCUIT BOARD

The backside overglaze 56 is not present along the lower edge portion of substrate 10 except at the outer end thereof where the lowermost run of the meandering serpentine film is present, and except at the indicated (FIG. 2) downwardly-extending fingers between the respective terminals 33, 34, 33*a* and 34*a*. There are two pads present on such lower edge, numbered 61, 62 in FIGS. 4 and 6. These pads are registered with the corresponding pads on the frontside of the substrate.

Pad 61 is blind, while pad 62 connects to the lowermost inboard run portion of the horizontal serpentine film as shown in FIG. 6. Each set of terminals or pins connects to the pads on both sides of the substrate. Thus, terminals 33 connect to pads 37 and 61*b*; terminals 34 connect to pads 38 and 62*b*; terminals 34*a* connect to pads 38*a* and 62; and terminals 33*a* connect to pads 37*a* and 61. Reference is again made to FIG. 9*b*, drawing sheet 3.

It is possible that, under some conditions, both vertical fractures will be inboard of the innermost terminals 34 and 34*a*. In such case, there can be a section of substrate that has fractures on both sides thereof and thus is not supported by any terminal and accordingly may fall onto the line card and the electronics thereon. There are next described a simple, economical and no-labor means and method for preventing this from happening.

By extending the backside metalization pad 62 inwardly, almost but not quite to the CL, there is provided an extension arm 64. Solder will adhere, when the part is dipped in a molten bath of solder, to any metalization not covered by the glass or overglaze 56 (FIG. 2). It follows that during solder-dipping, not only are the terminals mechanically and electrically connected to their respective pads, but solder 66 is adhered over the extension arms 64 as shown in FIG. 2.

Because the solder is ductile and malleable instead of brittle, it does not break when the fracture occurs. Furthermore, there is a meniscus that is formed so that at certain regions, the solder is several thousandths of an inch thick. Accordingly, the solder provides a bridge across each crack, and this bridge tends to prevent the central region of the resistor from dropping onto the line card. It is pointed out that even a small retaining force is typically effective to prevent such dropping, in that at common overload voltages the ceramic does not break in any major or explosive manner, but instead merely cracks—the facing edge surfaces of the ceramic on opposite sides of each crack being closely adjacent each other.

FURTHER DESCRIPTION OF THE EMBODIMENT OF FIGS. 1–6

There is here continued the description of the method and article of the embodiment of FIGS. 1–6. The backside elements shown in FIGS. 2, 4 and 6 are exemplary of elements whose backside heating (or absence of it) is such that the functions described under the heading "Description of the Method and of the Operation of the Article as Thus Far Described" are not interfered with. Regardless of the above-described trimming employed relative to the backside circuit elements, and regardless of the presence or absence of solder 66 on bar 64 (and corresponding solder 66*b* on bar 64*b*), the embodiment of FIGS. 1–6 operates in the vertical-fracture manner described. Referring to FIG. 2, there is shown a phantom line 71 that generally surrounds the cold areas resulting from backside heating of the substrate. These cold areas, and the backside-heated areas outside of them, are exemplary of backside cold and heat regions that do not prevent the U-shaped containment described relative to FIG. 1 from operating satisfactorily.

In the present example, the front and back resistors on the left side of the CL are connected electrically to each other and combine to form "one resistor" of the resistor pair. Correspondingly, the front and back resistors on the right side of the CL are connected electrically to each other and form the "other resistor" of the pair. Such one resistor and such other resistor are in the great majority of cases caused to have resistances that are equal to each other. As an example, the resistance on each side of the CL is 50 ohms.

In the present example, the front and back resistors on each side of the CL are connected in series with each other. The series circuits are through springs next described. The connections could be parallel instead of series.

Some lower telephone line power-cross overloads, below 120 volts rmsAC (such as 30 volts rmsAC on 50 ohms), are such that the fracture may not occur on certain sizes of substrates. There could then result circuit board damage due to overheating. For lower overload conditions, a thermal cutoff spring is provided on each side of the CL as described in the cited patent. This spring opens and interrupts the current before the circuit board is damaged.

There are upper and lower frontside pads 72, 73 (FIG. 3) and an upper backside pad 74 (FIG. 4). Pad 72 is blind; pad 73 is connected to metalization 26; and pad 74 is connected to a pad 76 beneath the right end of the uppermost horizontal run of film 46.

An electrically conductive spring clip 77 is soldered to pad 73 during the above-described dipping process and has an upper end that is soldered to pad 72 and also pad 74—hooking over the upper edge of the substrate. As described in the cited patent, the spring clip 77 is soldered to pad 73 under stressed condition and is accordingly urged outwardly at the lower end thereof on the frontside of the substrate. Thus, when solder melting occurs, as a result of a low overload, the lower end of the frontside spring portion moves outwardly and breaks the circuit.

EMBODIMENT OF FIGS. 7–9

Figure 9A:
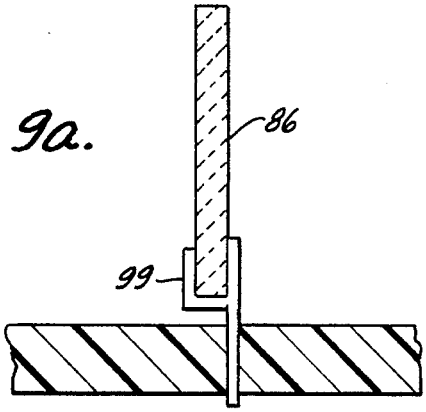
FIG. 9*a* is a vertical cross-section showing any one of the terminals or pins; for example, one at the center of FIG. 7.
Figure 7:
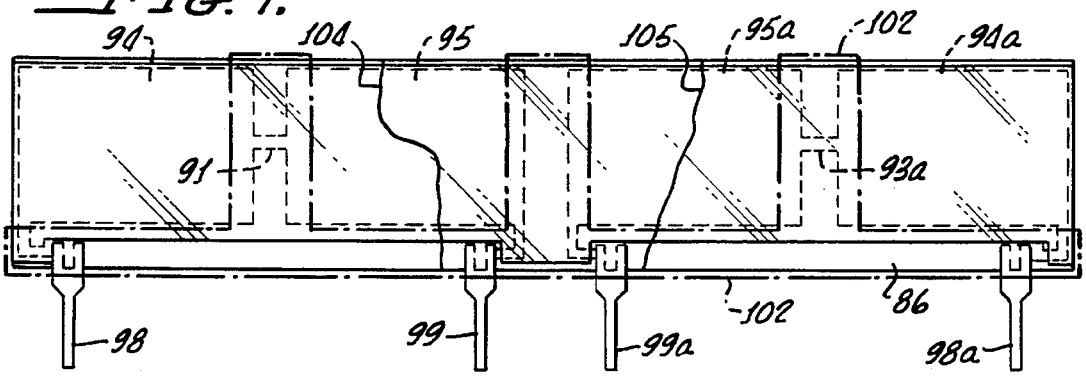
FIG. 7 is a frontside view of a second embodiment of the invention.
Figure 8:
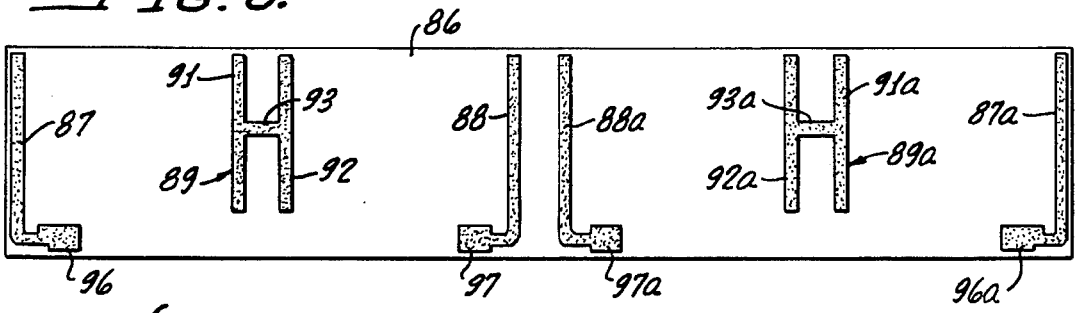
FIG. 8 shows the resistor pair of FIG. 7 without overglaze or resistive films or terminals.
Figure 9:
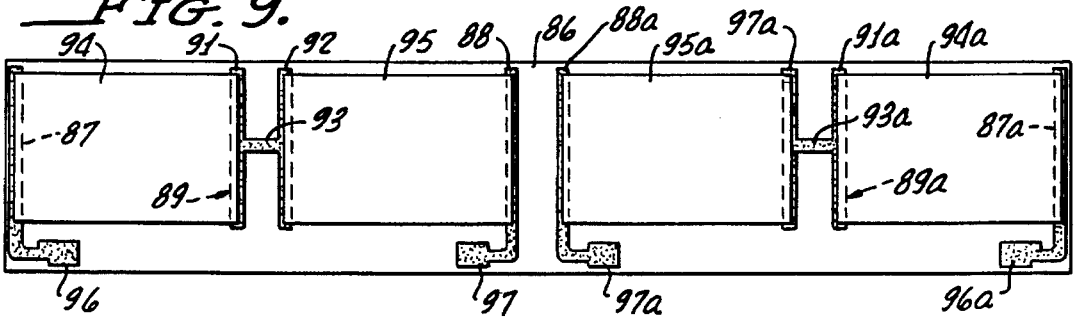
FIG. 9 shows the resistive films applied to the substrate and metalizations of FIG. 8.

Referring to FIG. 7, there is shown an elongate substrate 86 for a balanced pair of telephone line resistors. As stated relative to the first embodiment, the various elements shown in FIGS. 7–9 are mirror images about the CL. Thus, only the left resistor is described; the elements on the right side of the CL having the same reference numerals but followed by the letter "a".

Referring to FIG. 8, there is a vertical high-conductivity metalization trace 87 along the left edge of substrate 86 and closely adjacent such edge. There is another metalization trace 88 parallel to trace 87 and spaced to the left of the CL. An H-shaped, high-conductivity metalization trace 89 is located intermediate traces 87, 88, being shown as midway therebetween. The metalization 89 has two vertical legs 91, 92 that are spaced horizontally from each other and connected by a cross-bar 93.

As shown in FIG. 9, a first rectangular resistive film 94 is screen-deposited between trace 87 and leg 91, and is also overprinted on such elements. A second rectangular resistive film 95 is deposited between leg 92 and trace 88 and overprinted thereon. The upper edges of films 94, 95 are closely adjacent the top edge of substrate 86. The lower edges of films 94, 95 are spaced upwardly from the bottom edge of the substrate.

As shown in FIGS. 8 and 9, metalization pads 96, 97 are respectively connected to traces 87, 88. They have terminals or pins 98, 99 soldered thereto. As previously stated, FIG. 9*a* shows terminal or pin 99 and the associated line card, the solder being unshown.

The resistive films are (in this and subsequently described embodiments) trimmed to the desired resistance value by laser-cut lines (not shown) in the resistive films, extending horizontally and varying in width.

The backside of the substrate is plain, in the present example, except for blind metalization pads for the soldering of pins 98, 99.

As indicated by the phantom line 102 in FIG. 7, there is a U-shaped cold zone with a first cold vertical arm at the center of substrate 86, and a second cold vertical arm between the outer edges of the vertical metalization legs 91, 92. By "outer edges" is meant the left edge of leg 91 and the right edge of leg 92. The indicated first cold vertical arm extends from the left edge of leg 88 to the right edge of leg 88*a*.

The base of the indicated U-shaped cold zone is along the bottom edge of the substrate, directly below film 95.

The resistive films 94, 95 are in series with each other through the crossbar 93, between the pins 98, 99. Thus, when a sufficient overload is applied to the pins, film 95 expands rapidly but is surrounded by the above-described U-shaped cold zone. Thus, as described above, substantially or generally vertical cracks or fractures 104, 105 (the latter being on the right side of the CL) are formed to break the circuit (circuits) between the various pins.

It is emphasized that although there are spaces between the legs 91, 92, and below the films, the substrate's surface is efficiently used in that the resistive film extends very close to the top edge of the substrate and the end edges thereof.

EMBODIMENT OF FIGS. 10–12

Figure 10:
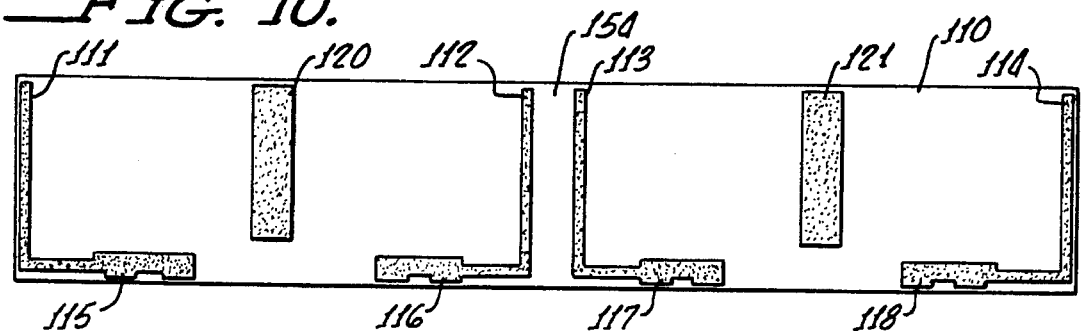
FIG. 10 corresponds to FIG. 8 but shows the substrate and metalizations of a third embodiment of the invention.

Referring to FIG. 10, an elongate substrate 110 has metalizations 111, 112, 113, 114, 115, 116, 117 and 118 thereon corresponding generally to those shown and described relative to FIG. 8. Metalizations 111–114 are for the ends of the resistive films, while metalizations 115–118 are pads for the terminals. The backside of substrate 110 is plain, except for metalization pads for connection of the terminals.

Additional and critical metalizations 120, 121, each vertically elongate, are applied and respectively located intermediate the respective metalizations in each set 111, 112 and 113, 114 thereof.

Figure 11:
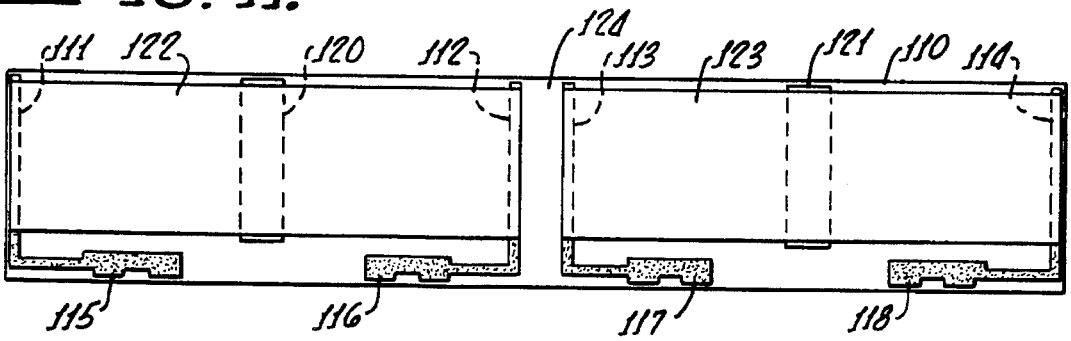
FIG. 11 corresponds to FIG. 10 but shows also the resistive films.

Resistive films 122, 123, each of which is solid and horizontally elongate, are applied over all vertically extending metalizations (including 120, 121) as shown in FIG. 11, close to the top of the substrate but spaced from the bottom thereof.

The adjacent ends of the resistive films are separated from each other by a vertical cold arm 124. Metalizations 120, 121 also form vertical cold arms because the current flows through them instead of through the resistive films.

Figure 12:
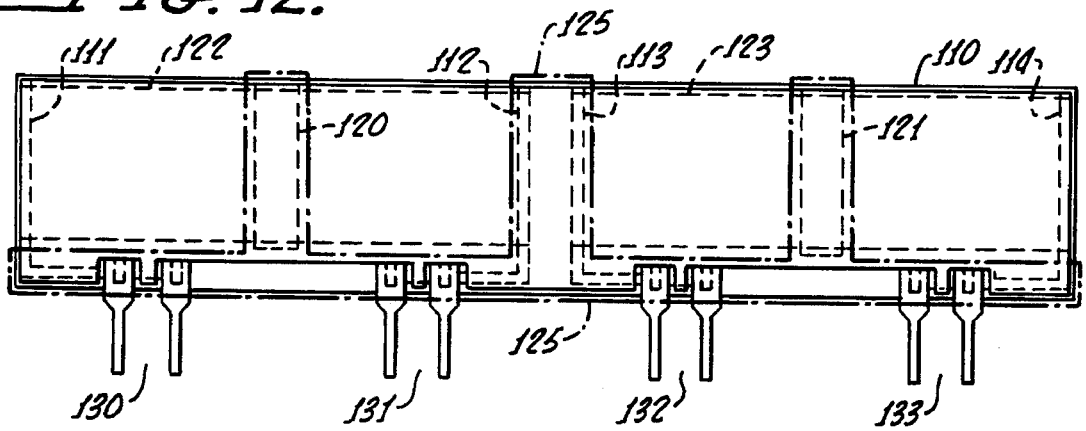
FIG. 12 shows the finished resistor pair of the third embodiment.

Thus, two U-shaped cold regions are formed, as generally shown by the phantom line 125 in FIG. 12. This causes the above-described containment and vertical fractures in response to high overloads. There result vertical fractures respectively between 112 and 120 and between 113 and 121.

The metalizations 120, 121 could, alternatively, be applied over the resistive films, but this is not preferred.

The widths of the arms, and of the base of each U, are intentionally so selected as to cause the vertical fractures.

Sets of terminals 130, 131, 132 and 133 are then soldered to the pads therefor—after application (and firing) of the overglaze.

EMBODIMENT OF FIGS. 13–15

An elongate rectangular substrate 140 has (FIG. 13) vertical metalizations (traces) 141, 142, 143 and 144 applied in spaced relationship therealong. These connect, respectively, to pads 145, 146, 147 and 148 for pins 149, 150, 151 and 152 (FIG. 15).

The central metalizations 142, 143 are preferably in the center of the substrate and are spaced from each other on opposite sides of the CL to form a vertical arm or gap 154. Metalizations 141, 144 are respectively spaced from the ends of the substrate to form vertical arms 155, 156.

Resistive films 158, 159 are provided respectively between metalizations 141–142 and 143–144. These are close to the top of the substrate, but spaced from the bottom thereof.

Figure 15:
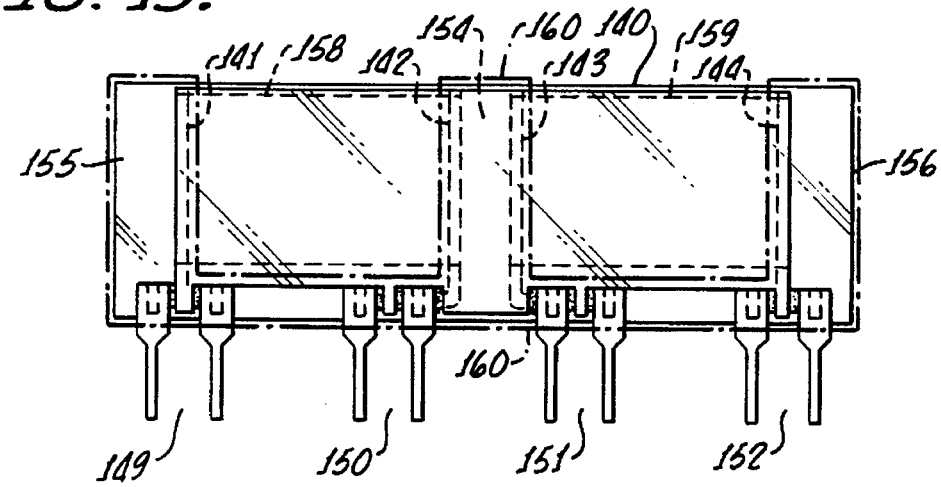
FIG. 15 shows the finished resistor pair of the fourth embodiment.

Thus, two U-shaped cold areas are formed, as generally shown by the phantom line 160 in FIG. 15. The width of the arm of each U is substantially equal to or somewhat greater than the vertical dimension of the base of the U.

Figure 13:
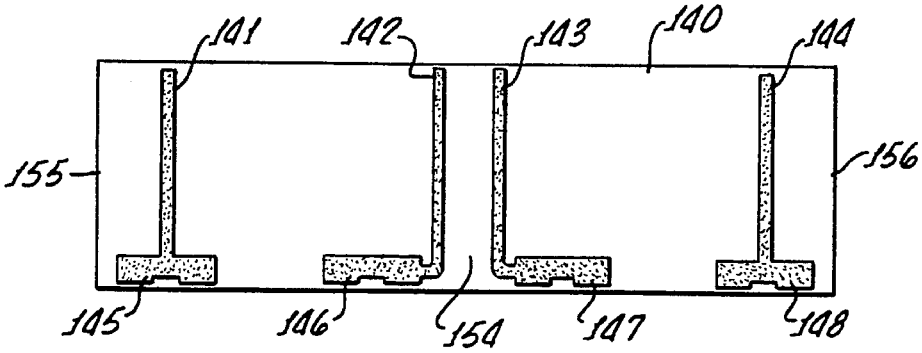
FIG. 13 shows the substrate and metalizations of a fourth embodiment.
Figure 14:
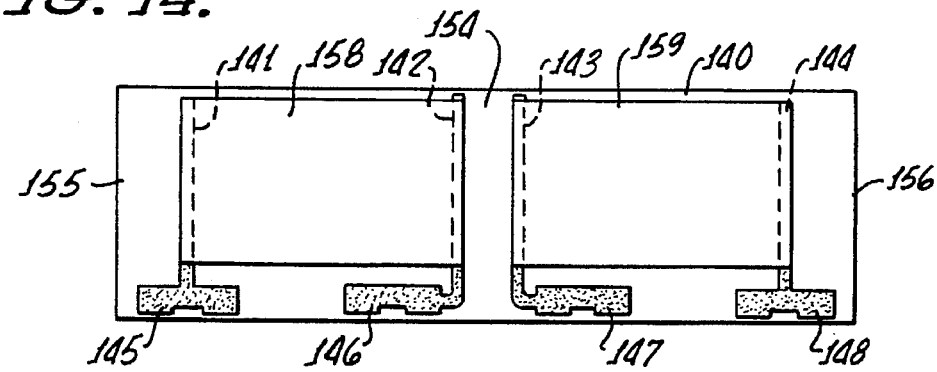
FIG. 14 corresponds to FIG. 13 but shows also the resistive films.

The backside of the embodiment of FIGS. 13–15 is plain, except for metalization pads for soldering of the terminals.

ADDITIONAL DISCLOSURE

In all of the embodiments of FIGS. 1–15, inclusive, there is preferably the same substrate material having the expansion characteristics stated relative to the embodiment of FIGS. 1–6. This is preferably aluminum oxide, as described in the cited patent. The thickness of the thin flat substrate may vary, with the thinner substrates fracturing more rapidly than those less thin. Typical thicknesses are 0.030 inch, 0.040 inch, 0.025 inch, and 0.035 inch.

The metalizations and resistive films of the embodiments of FIGS. 1–15 are applied and fired as described herein and/or in the cited patent.

In each embodiment of FIGS. 1–15, overglaze is applied and fired as described in the cited patent.

In all embodiments, the terminals are mechanically and electrically connected to circuit boards or line cards. The illustrated (FIGS. 1, 2, 7, 9*a*, 12 and 15) preferred terminals (terminal pins) are sufficiently stiff to hold the substrates vertical.

It is emphasized that, in its preferred form, the resistor has a low profile, namely a relatively short height above the circuit board. This is extremely desirable for the telephone line cards.

The foregoing detailed description is to be clearly understood as given by way of illustration and example only, the spirit and scope of this invention being limited solely by the appended claims.

What is claimed is:

1. A resistor characterized by reduced possibility that debris resulting from fracture will fall onto underlying elements, said resistor comprising:

(a) a thin flat substrate having such thermal coefficient of expansion that it will fracture in response to thermal stress, said substrate having two opposed edges, (b) a resistive film provided on a large part of at least the frontside of said substrate, (c) first and second terminal means for said resistive film, said terminal means connecting to one of said opposed edges and to said resistive film, (d) first and second cold arms extending generally between said opposed edges and with at least large parts of said arms being in spaced relationship from each other, said cold arms being parts of said substrate that are not subjected to major frontside heating caused by current flowing through said resistive film, said cold arms having at least a substantial part of said resistive film located between them, said substantial part of said resistive film extending to adjacent the other of said opposed edges, said cold arms and said substrate being so dimensioned and so located and so related to each other that a sufficient overload voltage will reliably and repeatably cause said substrate to fracture in the region between said cold arms, and with the direction of fracture being generally between said one opposed edge and said other opposed edge, thereby breaking a circuit through said resistive film between said terminal means, whereby the fractured components of said substrate are held, by said terminal means, against falling away from said terminal means and any support to which said terminal means are connected.

2. The resistor according to claim 1, in which said overload voltage is in the range of from about 60 volts rmsAC to about 230 volts rmsAC.

3. The resistor according to claim 1, in which the portions of said cold arms adjacent said one opposed edge are connected to each other by a cold region of said substrate.

4. The resistor according to claim 3, in which said cold arms and cold region combine to form a general U-shape, with said cold region being the base of said U-shape.

5. The resistor according to claim 1, in which each of said cold arms is at least 0.06 inch wide.

6. The resistor according to claim 4, in which said base has a dimension, in a direction transverse to said one opposed edge, that is substantially equal to or somewhat smaller than the width of each of said cold arms.

7. The resistor according to claim 1, in which said first and second terminal means are at least two terminal pins mechanically connected to said one opposed edge, said pins being sufficiently stiff to hold said substrate, and portions thereof, upright, said pins being secured in a circuit board.

8. The resistor according to claim 1, in which said resistive film is a serpentine film.

9. The resistor according to claim 1, in which resistive film is provided on the backside of said substrate, said backside film being so constructed as not to interfere with formation of the fracture in said direction.

10. A debris-reducing resistor combination, comprising:

(a) a rectangular, thin, flat substrate having such a thermal coefficient of expansion that it will fracture in response to thermal stress, (b) terminal means mechanically connected to the bottom edge of said substrate and adapted to hold said substrate on a circuit board, (c) resistive film means provided on the frontside of at least a major portion of said substrate, and electrically connected to said terminal means, and (d) at least first and second cold arm means each extending upwardly from the vicinity of said bottom edge to the vicinity of the top edge of said substrate, said cold arm means being spaced from each other in a direction longitudinal to said substrate, said cold arm means being so located as to divide said resistive film means into at least two film sections, each of said film sections generating substantial frontside heating of said substrate at the portions of said substrate respectively underlying said film sections, each of said cold arm means being such that the portions of said substrate respectively underlying said cold arm means are not subjected to substantial frontside heating, said cold arm means being so dimensioned, located and associated that when a sufficiently high overload voltage is applied to said terminal means, the portion of said substrate underlying at least one of said film sections is substantially repeatably fractured to form cracks in a direction extending between said bottom edge and the top edge of said substrate, thereby breaking a circuit through said one film section.

11. The debris-reducing resistor combination according to claim 10, in which there is also a third cold arm means extending generally between the vicinities of said bottom and top edges, said first, second and third cold arm means being so located as to divide said resistive film means into at least four film sections, each of said film sections generating substantial frontside heating of said substrate at the portions of said substrate respectively underlying said film sections, each of said cold arm means being such that the portions of said substrate respectively underlying said cold arm means are not subjected to substantial frontside heating, said cold arm means being so dimensioned, located and associated that when a sufficiently high overload voltage is applied to said terminal means, the portions of said substrate underlying at least said two of said four film sections are substantially repeatably cracked or fractured in a direction extending between said bottom edge and said top edge of said substrate, thereby breaking the circuit through said two film sections.

12. The debris-reducing resistor combination according to claim 10 in which each of said cold arm means is at least 0.06 inch wide.

13. The debris-reducing resistor combination according to claim 11 in which each of said cold arm means is at least 0.06 inch wide.

14. The debris-reducing resistor combination according to claim 10, in which there is also a cold arm section extending along said bottom edge of the frontside of said substrate between said first and second cold arm means, and cooperating with said first and second cold arm means to create a generally U-shaped cold area of said substrate.

15. The debris-reducing resistor combination according to claim 14 in which each of said cold arm means is at least 0.06 inch wide.

16. The debris-reducing resistor combination according to claim 10, in which two adjacent ones of said resistive film sections are connected in circuit with each other by film means on said substrate that extends across one of said cold arm means.

17. The debris-reducing resistor combination according to claim 16, in which said film means that extends across one of said cold arm means comprises high-conductivity film.

18. The debris-reducing resistor combination according to claim 14, in which said sufficiently high overload voltage is in the range of from about 60 volts rmsAC to about 230 volts rmsAC.

19. The debris-reducing resistor combination according to claim 14, in which the vertical dimension of said cold arm section is substantially equal to or somewhat smaller than the width of each of said cold arm means associated therewith.

20. The debris-reducing resistor combination according to claim 10, in which said resistive film means is a serpentine film.

21. The debris-reducing resistor combination according to claim 10, in which resistive film is provided on the backside of said substrate, said backside film being so constructed and located as not to interfere with formation of said cracks in said direction.

22. A debris-reducing resistor, comprising:

(a) a rectangular substrate having such a thermal coefficient of expansion that it will fracture in response to thermal stress, (b) resistive film means provided on said substrate, and (c) terminal means provided at the bottom edge of said substrate and electrically connected to said resistive film means, characterized in that said film means is spaced from said bottom edge of said substrate, further characterized in that said film means is spaced from both side edges of said substrate, further characterized in that there is no high-conductivity trace on said substrate between the top edge of said film means and the top edge of said substrate, and further characterized in that said film means and the spaces below and laterally thereof are such that application of sufficiently high overload voltage to said film means causes said substrate to crack along a line extending between said top and bottom edges and through said film means, thereby breaking any circuit through said film means.

23. The debris-reducing resistor according to claim 22, in which the top edge of said film means is adjacent the top edge of said substrate.

24. The debris-reducing resistor according to claim 22, in which said film means is serpentine in configuration.

25. The debris-reducing resistor according to claim 22, in which said film means is substantially solid.

26. A debris-reducing resistor comprising:

(a) a substrate having such a thermal coefficient of expansion that it will fracture in response to thermal stress;

(b) terminal means provided on a lower edge of said substrate, and (c) a resistive film provided on one side of said substrate and connected to said terminal means, said film being shaped in a meandering pattern having corner portions and substantially straight portions, said film having, in at least some of said substantially straight portions, at least one section the resistance of which is low in comparison to the resistance of most other straight portions of said film, thereby to create at said one section little or no heating of the portion of said substrate beneath said one section, and thereby affecting the lines of thermal stress generated in said substrate during overload conditions, characterized in that a plurality of said low-resistance sections are provided in a plurality of said substantially straight portions, said low-resistance sections being generally in line with each other to create a relatively cold arm region of said substrate, said arm extending transversely to said straight sections, and further characterized in that said sections are such and are so related to said resistance film that a vertical crack or fracture is caused in said substrate in response to application of a high overload voltage to said terminal means.

27. The debris-reducing resistor according to claim 26, in which each said low-resistance section is formed by a high-conductivity layer thereat.

28. The debris-reducing resistor according to claim 26, in which said low-resistance sections are formed by high-conductivity metalization traces thereat.

29. A debris-reducing telephone resistor combination, comprising:

(a) a thin, flat, square or rectangular substrate having such a thermal coefficient of expansion that it will fracture in response to thermal stress, (b) terminal means connected to one edge of said substrate, (c) first and second resistive film portions provided on the frontside of said substrate and connected to said terminal means, said first and second film portions being spaced from each other to form a gap, said gap extending in a direction transverse to said one edge, and (d) a low-resistance connection provided across said gap and connected to said first and second film portions to cause said film portions to be in series-circuit relationship with each other, the series combination of said film portions being connected to said terminal means, said gap creating a cold arm in said substrate extending transverse to said one edge, said substrate having another cold arm therein on the side of said second film portion that is remote from said gap, said two cold arms being so sized and related that when a sufficiently high overload voltage is applied to said terminal means, a crack will be formed in said substrate in a direction extending along a line between said one edge of said substrate and the edge of said substrate remote therefrom, said crack traversing one of said film portions and causing breaking of said series circuit.

30. The debris-reducing resistor combination according to claim 29, in which said low-resistance connection provided across said gap comprises a high-conductivity film on said substrate.

31. The debris-reducing resistor combination according to claim 29, in which each of said film portions is serpentine, and said low-resistance connection comprises a high-conductivity film portion.

32. The debris-reducing resistor combination according to claim 29, in which each of said film portions is solid, and in which said low-resistance connection comprises a high-conductivity film portion.

33. The debris-reducing resistor combination according to claim 29, in which said one edge of said substrate has adjacent thereto a cold portion of said substrate that extends between said arms to form a generally U-shaped cold area around one of said film portions.

34. A telephone line interface resistor pair, which comprises:

(a) an elongate, rectangular ceramic substrate having a thermal coefficient of expansion such that said substrate will fracture in response to sufficient thermal stress, (b) first and second resistive films provided on said substrate on opposite sides of the CL, each of said films being spaced from said CL to provide a cold center region of said substrate, (c) sets of terminal pins connected to the lower edge portion of said substrate of opposite sides of said CL, said substrate being substantially devoid of resistive film along said lower edge portion near said terminal pins whereby said lower edge portion is cold, said sets of terminal pins being respectively electrically connected to said resistive films, and (d) electrical means to provide first and second cold arms respectively at said first and second resistive films, each of said first and second cold arms extending generally from said lower edge portion of said substrate to the top edge portion thereof, each of said first and second cold arms traversing one of said first and second resistive films, said cold arms and said cold center region and said lower edge portion and said resistive films being so shaped, disposed and related that application of sufficiently high overload voltages to said sets of terminal pins reliably causes cracks in said substrate and that extend between said lower edge portion and the top edge portion of said substrate and that traverse said resistive film portions that lie respectively between said cold center region and said first and second cold arms.

35. The telephone line interface resistor pair of claim 34, in which said first and second cold arms are each formed by providing gaps in said first and second films, each of said gaps each being at least 0.06 inch wide.

36. The telephone line interface resistor pair of claim 34, in which at least one of said first and second cold arms is formed by providing a layer of relatively high-conductivity material along said one cold arm.

37. The telephone line interface resistor pair of claim 34, in which each of said films is serpentine.

38. The telephone line interface resistor pair of claim 34, in which each of said films is solid.

39. A method of intentionally greatly reducing the chances that telephone resistor debris will drop beneath a telephone resistor, said method comprising the steps of:

(a) selecting a thin, flat substrate that has such a thermal coefficient of expansion that it will fracture when sufficient thermal stress is created therein, (b) providing termination means on one edge portion of said substrate, (c) intentionally providing resistive film on said substrate in such pattern, location, and construction that when current passes through said film, there will result in said substrate a generally U-shaped, relatively cold zone largely encompassing a relatively hot zone, the latter resulting from passage of said current through primarily resistive portions of said film that are largely encompassed by said cold zone, and further intentionally causing said cold zone and hot zone to be such that in response to application of sufficient overload voltage to said termination means, said zones will reliably cause a crack to form in said substrate along a line that extends from said one edge portion through said film to break the circuit through said film, and (d) mounting said termination means to a telephone line circuit board in such manner that after said crack formation, the separated pieces of said substrate will be held in place by said termination means and board.

40. A resistor combination, which comprises:

(a) a thin, flat substrate adapted to fracture and break whenever sufficiently high thermal stress is generated therein, (b) a resistive film applied to at least one side of said substrate, (c) terminals mechanically connected to one edge portion of said substrate and connected to said resistive film, (d) cold arm means associated with said resistive film in such manner that the presence of a sufficiently high overload voltage in said terminals will cause said substrate to crack and form a crack in a direction generally from said one edge to an opposite edge, and through said film to break the circuit therethrough, and (e) solder provided along at least part of said one edge, said solder not having any substantial attachment or lead connection functions, said solder being for the purpose of, and achieving, substantial augmenting of support for the substrate fragments resulting from said crack.

41. The resistor combination according to claim 40, in which said terminals are soldered to said substrate, and by the same solder that is provided along at least part of said one edge.

42. The resistor combination according to claim 41, in which said one edge has metalization pads thereon adapted to seat said terminals, and metalization pad means thereon shaped like said augmenting solder, and in which said terminals are soldered to the pads therefor and said augmenting solder is applied to said pad means by dipping said one edge in a bath of molten solder.

43. A resistor combination for handling overloads of different magnitudes, which comprises:

(a) a substrate adapted to fracture in response to thermal stress;

(b) film means provided on said substrate, and including resistive film means, (c) terminal means associated with said substrate at one edge thereof, and connected to said resistive film means, (d) means to cause said substrate to crack reliably in a direction between said one edge and an edge opposed thereto, and through said film means, to break a circuit through said film means, in response to application of a relatively high overload voltage to said terminal means, and (e) a stressed spring held by solder to said substrate and in circuit with said film means, said spring being adapted to break the circuit upon melting of said solder when there is relatively low overload voltage applied to said terminal means.

* * * * *